United States Patent [19]

Amlinger

[11] Patent Number: 4,629,407

[45] Date of Patent: Dec. 16, 1986

[54] APPARATUS FOR THE MANUFACTURE OF METAL POWDER BY ATOMIZATION FROM A NOZZLE WITH NOBLE GAS OR NITROGEN

[75] Inventor: Heinrich Amlinger, Niddatal, Fed. Rep. of Germany

[73] Assignee: Leybold-Heraeus GmbH, Cologne, Fed. Rep. of Germany

[21] Appl. No.: 749,570

[22] Filed: Jun. 27, 1985

[30] Foreign Application Priority Data

Jun. 27, 1984 [DE] Fed. Rep. of Germany ..... 3423597

[51] Int. Cl.[4] ..... B22F 9/08

[52] U.S. Cl. ..... 425/7; 264/12; 264/37; 425/210; 425/815

[58] Field of Search ..... 425/6, 7, 210, 815; 264/5, 9, 11, 12, 37, 39; 75/25

[56] References Cited

U.S. PATENT DOCUMENTS

| | | | |
|---|---|---|---|
| 2,587,614 | 3/1952 | Golwynne | 264/37 |
| 2,638,626 | 5/1953 | Golwynne | 425/7 |
| 4,111,672 | 9/1978 | Battigelli et al. | 425/7 |
| 4,179,278 | 12/1979 | Beggs et al. | 75/25 |

*Primary Examiner*—Jay H. Woo
*Assistant Examiner*—J. Fortenberry
*Attorney, Agent, or Firm*—Felfe & Lynch

[57] ABSTRACT

Apparatus for the manufacture of metal powder by atomization with noble gas or nitrogen, having an atomization tower, a gas recycling system, and a gas cleaning system is disclosed. The gas cleaning system is connected parallel to the atomization tower in order to shorten the start-up time without increasing the cost and complexity of the gas cleaning system.

9 Claims, 2 Drawing Figures

APPARATUS FOR THE MANUFACTURE OF METAL POWDER BY ATOMIZATION FROM A NOZZLE WITH NOBLE GAS OR NITROGEN

BACKGROUND OF THE INVENTION

The invention relates to an apparatus for the manufacture of metal powder by atomization from a nozzle with gas, having a spraying tower, a gas recycling system and a gas cleaning apparatus.

Usually, metal powder production apparatus operating on the gas atomization principle are operated without a gas recycling system. The essential reason for this is the idea that cleaning vaporous and/or gaseous impurities as well as entrained particles of metal powder from the circulating gas is difficult to perform and involves high first costs. Since metal spraying is used especially for the production of superalloys for aircraft engine parts, and any chemical or mechanical impurity in the gas results in appreciable impairment of the quality of these parts, gas recycling has, as a rule, been avoided, and the higher gas costs are accepted in the production of the powder.

In a previously proposed apparatus for metal powder manufacture by gas atomization with a gas recycling system, it is known to remove mechanical impurities from the gas leaving the atomizing tower in a number of filters, then to carry it in a partial flow through a scrubber, and return the gas, thus freed of gaseous impurities, to the atomizing tower under elevated pressure. It is a disadvantage of the previously known apparatus that, after each opening of the gas circuit, especially each opening of the atomizing tower itself (e.g., after each batch), it takes a relatively long time before the gas being circulated for scrubbing regains the purity that is necessary for the start of the next batch. It would be conceivable to shorten the start-up time by operating the gas cleaning system, not on partial flow but on full flow. This, however, would require a substantial enlargement of the already complex gas cleaning system and thus result in a further increase of the invested cost.

It is an object of the present invention to improve a system of the kind described above so that shorter start-up time will be achieved without increasing the expense and complexity involved in the gas cleaning.

THE INVENTION

This object is achieved in accordance with the invention by connecting the gas cleaning system parallel to the atomization tower. This makes it possible, at least when the atomizing tower has been opened, to circulate through the cleaning apparatus the gases remaining in the tower after it has been closed, independently of the recycling system, and thus to clean them very rapidly. The recycling system itself is protected by valves against the entry of undesirable gases, so that, immediately after the gas present in the tower has been cleaned, the metal spraying operation can be resumed.

It is desirable to associate the atomizing tower with means for its evacuation and/or for purging it with gas. Thus the main part of the impurities can be removed by evacuation or purging ahead of the actual cleaning circuit, with the advantage that complex cleaning apparatus of large capacity are no longer necessary.

The invention is in principle useable for all types of molten metal. The type of gas used, is dependent on the particular molten metal which will be atomized. For example nickel-super alloy argon or helium will be used for atomization. For normal stainless steel or other metal argon or nitrogen can be used for atomization.

Depending on the kind of gas used (argon, helium, nitrogen) the gas purification can be accomplished by getters (in a titanium adsorber for example), or by chemisorption (in a copper bed) or the like.

The various features of novelty which characterize the invention are pointed out with particularity in the claims annexed to and forming a part of this specification. For a better understanding of the invention, its operating advantages and specific objects obtained by its use, reference should be had to the accompanying drawing and descriptive matter in which there is illustrated and described a preferred embodiment of the invention.

DESCRIPTION OF THE PREFERRED EMBODIMENT

Figure 1:
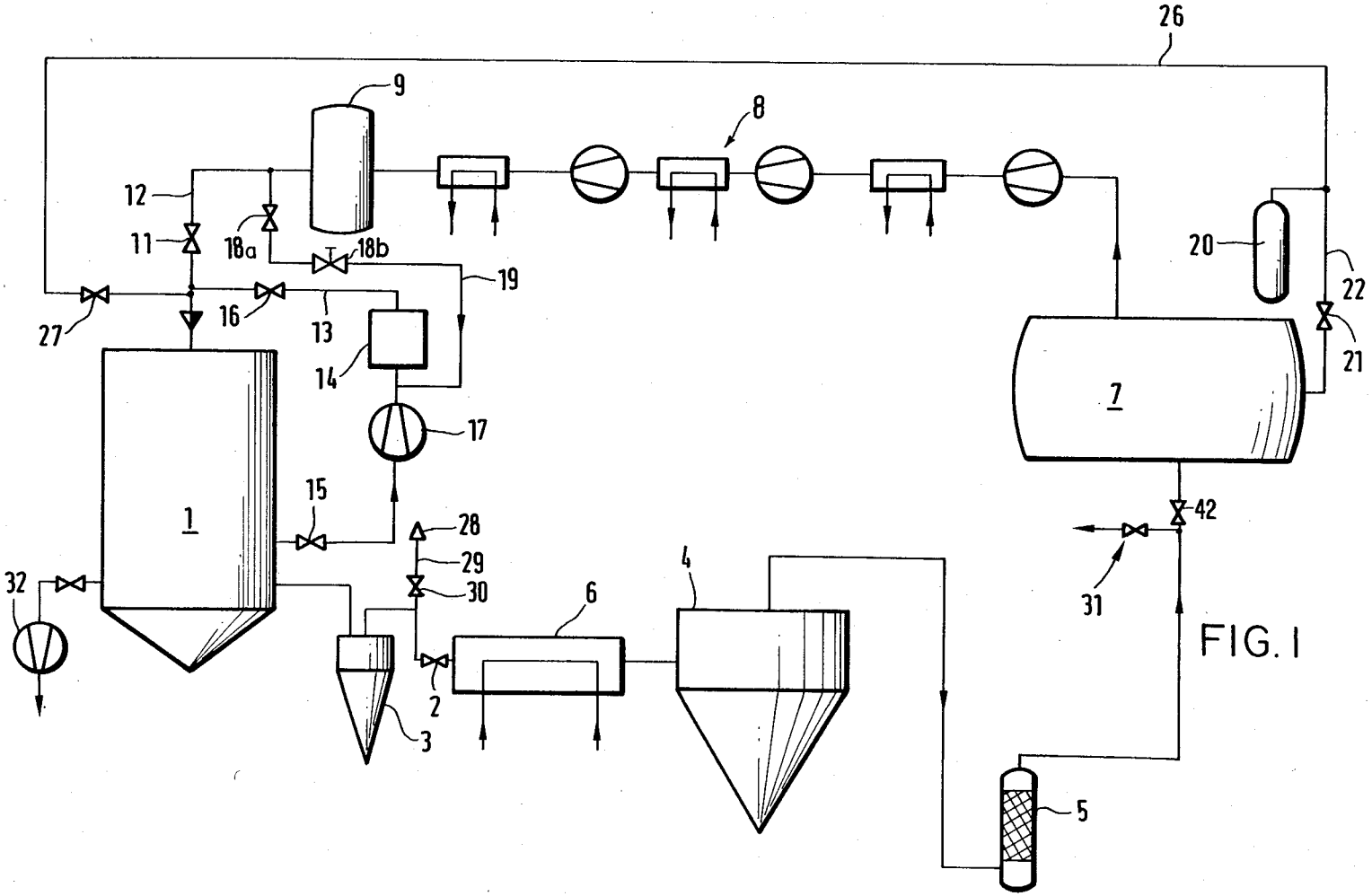
FIG. 1 schematically illustrates a preferred embodiment of the invention.

The spraying of molten metal takes place in the tower 1. The molten metal is atomized into the top of the tower with the gas that has been raised to high pressure (between 8 and 160 bar). The melt heat of the metal is yielded to the gas. Details relating to the feeding of the molten metal and removal of the metal powder are not shown but are known to those in the art.

The hot, metal dust-laden gas leaves the tower 1 and passes into a filter system consisting of two centrifugal air separators 3 and 4 and a fine filter 5. Valve 2 and also a gas cooler 6 are connected to the output from the first centrifugal air separator 3. The gas passes through a pulsation damper 7, a multistage compressor 8 with cooling between stages, another tank 9 serving as a pulsation damper, and the duct 12 equipped with the valve 11, back into the atomizing tower.

In a branch duct 13 connected parallel with the atomizing tower 1 there is a gas scrubber 14 generally represented by a block. This can be in the form of a titanium oven or adsorber, or of a copper adsorber with a molecularsieve filter. In the branch duct 13 are the valves 15 and 16 and the blower 17. Duct 13 is connected at its one end (valve 15) to the bottom part of the tower 1 and leads into the feed duct 12, so that the gas can be made to circulate through the tower and the scrubber 14. Lastly, another connecting duct 19 equipped with the valve 18 is provided, which connects duct 12 to duct 13 such that it leads into duct branch 13 at a point between the blower 17 and the gas scrubber 14.

Valve **18*a* is an on/off valve only. In operation either the loop with the compressor 17 will be used or the loop over valve 18*a*, line 19, line 13 and valve 16 will be used. In both cases the pressure in the purification loop will be limited to 10 bar. When using the loop with the compressor 17, the completely expanded gas from the atomization tower is withdrawn and compressed with compressor 17** to 10 bar.

If argon or helium is used as atomization gas, $O_2$ and $N_2$ can be removed with chemical getter effect on titanium cuttings at 800° C., where oxygen is converted into TiO and nitrogen into TiN. Regeneration of the TiO or TiN is not possible. If nitrogen is used as atomization gas, the removal of oxygen will be done on a copper-catalyst, where $O_2$ is separated through oxidation on a Cu-bed at approximately 170° C. with the reaction:

$$Cu+\frac{1}{2}O_2 \rightarrow CuO$$

The CuO-bed can be regenerated with a nitrogen/hydrogen mixture (1 to 3% $H_2$ and 97% nitrogen) with the reaction at 200° C.:

$$CuO+H_2 \rightarrow Cu+H_2O$$

The regeneration gas will be blown off to the atmosphere. If water is in the argon, it will be removed before the gas will be purified from $O_2$ or $N_2$ on Ti-cuttings respectively behind the Cu-bed. The water will be adsorbed on molecular sieves.

The molecular sieve can be regenerated by flushing a hot purified gas stream through the sieve which drives off the water. The regeneration gas can be blown off or will be led to the suction side of the recycling compressor. The Cu-bed and the molecular sieves are in two lines in such a way, that one line always operates and one is in regeneration. If copper is used, a molecular sieve will be installed in front of the copper adsorber.

Reference number 20 designates a gas supply tank which is connected by the line 22 equipped with valve 21 to the pulsation damper 7. From the gas supply tank 20 another line 26 with a valve 27 leads to the tower 1, and purging gases are fed by it to the tower 1. The purging gas outlet 28 is connected to the outlet of the centrifugal air separator 3 and includes the duct section 29 with the valve 30 ahead of the valve 2. Lastly, the valve 42 is disposed ahead of the tank 7.

Valve 2 is an isolation valve to keep the system clean when opening the tower. Bleed-off to gas circulation through cooler 6 will be done at the first purging of the system. For normal operation purging will only be necessary, when the tower has been opened; this purging gas will leave the system over valve 30.

Before start-up the entire system is purged and flooded with gas from tank 20 while valves 15, 16, 18, 30 and 42 are closed, namely through tank 7, compressor 8, duct 12, tower 1 and separators 3, 4 and 5. Valve 27 is open. This step can be preceded by an evacuation, for example, of the tower 1, in order to shorten the start-up process. The recycling purging gas exhaust is identified in general by the reference numbers 30 and 31. Valve 30 will be used when purging the tower only. Then valve 11 is closed and valves 16 and 18 are opened, so that the gas circulating through the compressor 8 flows through the branch 19 and the scrubber 14, being thus freed of the remaining impurities. This operation can be performed in a partial flow; this means that a metering valve is associated with valve 11 and valve 18 so as to permit a partial-flow operation of the gas cleaning apparatus when valves 11 and 18 are opened. Approximately 5 to 10% of the gas in the main stream will go to scrubber 14.

A titanium oven has proven to be especially desirable as the scrubber. It contains titanium heated to 700° to 1000° C. by which the thorough removal of the particularly harmful oxygen and nitrogen can be accomplished. If the gas has the necessary purity then the valves 16 and 18 are closed again, and valve 11 is opened, or the throttling valve is opened, as the case may be. The atomization of metal can then begin.

As a rule, it is necessary after the different atomizing operations only to open the tower. At this time the valves 2, 11, 15, 16 and 27 are closed, so that air or other gaseous impurities may not get into the gas circuit when opening the tower. After the tower is closed, first only valves 15 and 16 are opened, and the gas contained in the tower is circulated through the scrubber 14 by means of the compressor 17. It is advantageous first to evacuate the tower (vacuum pump 32) and then to flood it with inert gas, so that a large part of the contaminants is thereby already removed. This can be done through the duct 26 (while valves 2, 11 and 16 are closed and valve 27 is open) or by means of a gas supply tank similar to tank 20, associated with the tower itself, making use of the purging gas outlet 28, 30.

Figure 2:
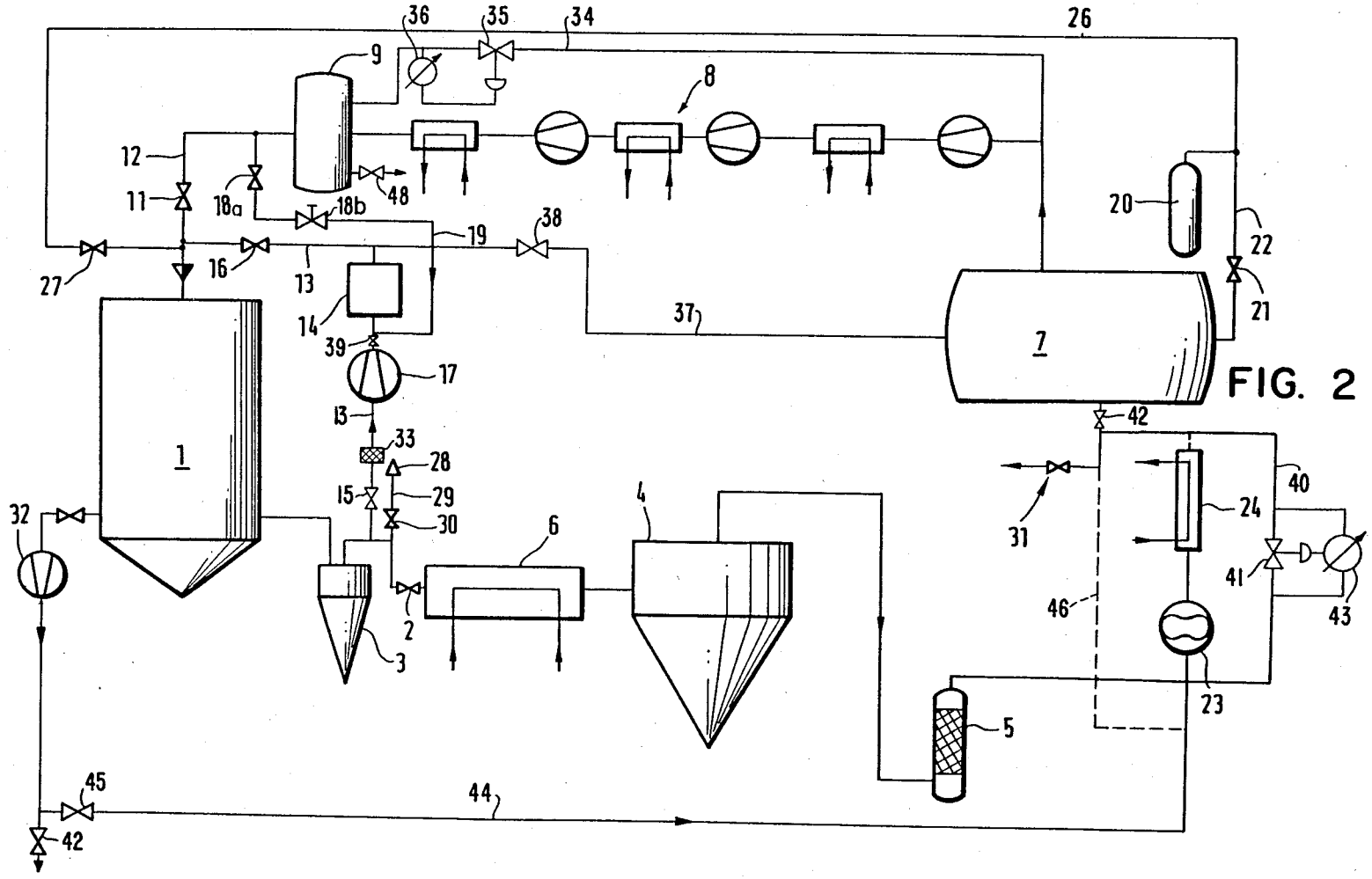
FIG. 2 shows an alternate embodiment of the invention.

The embodiment in FIG. 2 differs on several points from the embodiment shown in FIG. 1. First the line 13 connected parallel with the tower is connected to the gas scrubber 14, not directly at the bottom part of the tower 1, but between the centrifugal air separator 3 and the valve 2. A fine filter 33 is additionally provided in the line 13. This greatly relieves the load of mechanical impurities from the scrubber 14.

Another difference is that with the multi-stage compressor 8 there is associated a bypass line 34 with the valve 35. This bypass serves to prevent an excessively high pressure rise in the tank 9. The pressure is read at the meter 36. If it exceeds an allowable level, valve 35 opens.

Furthermore, in the embodiment shown in FIG. 2, the duct 13 between the scrubber 14 and valve 16 is connected directly to the tank 7 by line 37 with the valve 38. This branch line makes possible the following partial scrubbing circuit: tank 7, compressor 8, duct section 19, scrubber 14, duct section 37. In this case the valve 39 must additionally be provided in the duct 13 between the compressor 17 and the entrance 19 into the duct 13. It can be in the form of a nonreturn flap valve. The partial scrubbing circuit described is desirable for the start-up of the system and also after the system is opened.

Another difference is that a compressor 23, preferably in the form of a screw compressor or Roots blower, is preceded by a cooling system 24 to prevent any great heating of the gases. This system is desirable whenever the metal spraying, and thus the gas output, is discontinuous. The tank 7 serves in this case for gas storage. Another advantage of this system is that the compressor 8 can be of substantially smaller dimensions Again, a bypass (duct 40, valve 41, pressure gauge 43) is associated with the compressor 23 and the cooling system 24, which prevents an excessive pressure rise in the tank 7.

A section of duct 44 with the valve 45 is provided, which connects the output of the vacuum pump 32 to the tank 7, either through the compressor 23 and its cooling system 24 (discontinuous operation) or directly through the duct 46 represented in broken lines (continuous operation). Inert gas (preferably argon) pumped out of the tower 1 can be recovered through this line 44. During this recovery process, the output of the vacuum pump 32, which leads to the atmosphere, is closed by means of the valve 47.

The blower 23 and the cooler 24 are required for a system with intermittent recycling, which means that gas in the buffer vessel 9 contains all of the gas for one atomization cycle. The compressor 23 is switched on shortly before atomization and the compressor runs at first against the closed valve 42, and after reaching the maximum compression pressure, the compressor bypass valve opens. As long as the gas valve 11 to the atomization tower remains closed, the compressor runs via the bypass, or, when atomization is started by opening valves 11 and 2 the compressor bypass valve 41 closes according to the amount of gas which was fed into the atomization tower. This controlling is done on the suction side and on the discharge size of the compressor 23. The gas from the atomization tower will be drawn off through an oil-free screw compressor or Roots blower system 23, and will be compressed to a low pressure level and led to the buffer vessel 7. The compressor heat will be removed by the cooler 24. The compressor 8 is switched on automatically by a pressure switch when the pressure in the buffer vessel 7 is exceeded by a certain amount. As soon as the pressure in the high pressure buffer 9 reaches the end pressure, the compressor switches off. With this process the multi-stage compressor 8 can be made much smaller, but enough time must remain after sucking off with the screw compressor 23 until the next atomization batch is started.

After metal atomization and before opening the atomization tower and melting chamber, the argon in the tower and chamber can be recovered with a recovery system. After atomization and emptying the buffer vessel 7 to atmospheric pressure, the recovery system will be started by switching on the oil-free vacuum pump 32 and screw compression stations 23. The evacuation and compression stations will be switched off when the vacuum in the atomization tower reaches approximately 100 mbar 76 Torr.

The argon will be compressed in the buffer vessel to a certain pressure after it is recovered by evacuating the tower.

In order to compensate the argon losses during the evacuation of the tower and chamber, the buffer vessel 7 will be pressurized accordingly.

The pressurizing of buffer vessel 7 will be performed automatically after the argon has been recovered and stored in the buffer vessel.

The compressor 8 is switched on automatically by a pressure switch when the pressure in the buffer vessel 7 is exceeded by a certain amount.

The gas purification is switched on in a parallel stream to the compressor 8 to remove impurities resulting from the evacuation. Only a partial stream of the compressed gas will be purified and fed back to the compressor intake through the buffer 7.

When purging the filter line from separator 3 and filter 5, valve 30 will be closed and valve 31 and 27 will be opened. When purging vessel 7, compressor 8 and vessel 9, the valve 30 and 31 will be closed and the valve 48 on vessel 9 will be opened.

The present invention permits the recycling of the atomization gas and improves the quality of the metal powder produced, at relatively low investment cost. The special association of the gas cleaning system with the atomization tower shortens the start-up time between the individual batches, and makes the gas recycling possible.

In the embodiment represented in FIG. 2, the tank 9 is also equipped with a connection leading into the atmosphere and having a valve 48. This outlet, too, can be used as an outlet when a part of the recycling circuit is purged, namely tank 7, compressor 8 and tank 9.

The terms and expressions which have been employed are used as terms of description and not of limitation, and there is no intention in the use of such terms and expressions of excluding any equivalents of the features shown and described or portions thereof, it being recognized that various modifications are possible within the scope of the invention.

I claim:

1. Apparatus for the production of metal powder by atomization by noble gas or nitrogen, comprising an atomization tower, a gas recycling system and a gas cleaning system, wherein the gas cleaning system has a cleaning apparatus and is disposed together with a pumping blower in a branch duct connected parallel to the atomization tower and a duct supplies the tower with gas and is connected to the branch duct through a second duct equipped with a valve, in such a manner that the second duct leads to a point between the pumping blower and the cleaning apparatus.

2. The apparatus of claim 1, wherein means are associated with the atomization tower for evacuation.

3. The apparatus of claim 1, wherein the gas cleaning system is in the form of a titanium adsorber or copper bed with molecular sieve adsorber.

4. The apparatus of claim 1, wherein a centrifugal air separator precedes the gas cleaning system.

5. The apparatus of claim 1, further comprising a recycling system having means therein for the separation of mechanical impurities, a tank and a compressor, wherein the tank is preceded by a second compressor preferably in the form of a blower.

6. The apparatus of claim 5, wherein each compressor is followed by a respective tank and a respective bypass.

7. The apparatus of claim 5, wherein a connecting duct from the cleaning system to the tank is provided with a valve which permits a partial cleaning of the recycling circuit via the compressor, tank, duct, cleaning system and tank.

8. The apparatus of claim 1, wherein a vacuum pump is connected to the tower and its output is connected to the recycling system by a recycle duct for the recovery of aspirated inert gas.

9. The apparatus of claim 1, wherein means are associated with the atomization tower for purging with noble gas or nitrogen.

* * * * *